US006574855B1

(12) United States Patent
Hida

(10) Patent No.: US 6,574,855 B1
(45) Date of Patent: Jun. 10, 2003

(54) METHOD OF MAKING A SWITCH-EQUIPPED COAXIAL CONNECTOR

(76) Inventor: Kohei Hida, c/o Hirose Electric Co., Ltd., 5-23 Oosaki 5-chome, Shinagawa-ku, Tokyo (JP)

( * ) Notice: Subject to any disclaimer, the term of this patent is extended or adjusted under 35 U.S.C. 154(b) by 180 days.

(21) Appl. No.: 09/672,820

(22) Filed: Sep. 29, 2000

Related U.S. Application Data

(62) Division of application No. 09/398,004, filed on Sep. 16, 1999, now Pat. No. 6,241,541.

(30) Foreign Application Priority Data

Oct. 5, 1998 (JP) ..... 10-297613

(51) Int. Cl.[7] ..... H01H 11/00; H01H 11/02; H01H 11/04; H01H 65/00

(52) U.S. Cl. ..... 29/622; 29/592.1; 29/842; 29/874; 29/876; 29/881; 29/882; 439/188; 439/189; 439/465; 439/687; 439/696; 439/731; 439/916

(58) Field of Search ..... 439/188, 189, 439/916, 465, 731, 687, 696; 29/622, 592.1, 874, 876, 881, 882, 884, 842; 200/51.09, 51.1, 51.12

(56) References Cited

U.S. PATENT DOCUMENTS 4,118,610 A * 10/1978 Purssell et al. ..... 200/67 DA
4,250,367 A * 2/1981 Rossi ..... 200/275
4,633,048 A 12/1986 Komatsu
4,753,000 A * 6/1988 Stearns ..... 29/622
4,797,120 A * 1/1989 Ulery ..... 439/578
4,895,521 A * 1/1990 Grabbe ..... 439/63
4,988,307 A 1/1991 Muzslay
5,046,142 A * 9/1991 Ipcinski ..... 200/16 F
5,062,809 A * 11/1991 Sakamoto ..... 439/581
5,292,256 A * 3/1994 Brunker et al. ..... 439/108
5,320,546 A 6/1994 Weber
5,413,502 A 5/1995 Wang
5,456,612 A * 10/1995 van Grunsven et al. .... 439/188
5,693,924 A * 12/1997 Fetterolf et al. ..... 200/51.1
5,803,757 A * 9/1998 Wang ..... 439/188

FOREIGN PATENT DOCUMENTS

| | | |
|---|---|---|
| JP | 60-164774 | 11/1985 |
| JP | 61-116086 | 7/1986 |
| JP | 63-081783 | 4/1988 |
| JP | 64-031363 | 2/1989 |
| JP | 03-043977 | 2/1991 |
| JP | 08-167454 | 6/1996 |
| JP | 08-264233 | 10/1996 |
| JP | 10-022004 | 1/1998 |

* cited by examiner

*Primary Examiner*—Peter Vo
*Assistant Examiner*—Paul D Kim

(57) ABSTRACT

A method of making a switch-equipped coaxial connector comprises the steps of stamping a pair of switching members from a metal sheet, bending the stamped switching members to complete the switching members, press-fitting the switching members into separate housing sections, assembling the housing sections so as to connect the switching members, and providing an outer conductor over said housing sections.

2 Claims, 5 Drawing Sheets

METHOD OF MAKING A SWITCH-EQUIPPED COAXIAL CONNECTOR

CROSS REFERENCES TO RELATED APPLICATIONS

This is divisional application of prior application Ser. No. 09/398,004 file date Sep. 16, 1999 now U.S. Pat. No. 6,241,541.

BACKGROUND OF THE INVENTION

1. Field of the Invention

The present invention relates to methods of making coaxial connectors equipped with a switch and, more specifically, to a switch-equipped coaxial connector comprising a hollow insulating housing, a switching mechanism provided within the insulating housing and comprising a pair of switching members, one of which is connected with a pin of a mating connector for connection while it is separated from the other, and an outer conductor provided over the insulating housing and connected to the outer conductor of a mating connector.

2. Description of the Related Art

Switch-equipped coaxial connectors are used for switching antennas. A switch-equipped coaxial connector is provided in a mobile phone or the like. When placed at a predetermined position in the car, the mobile phone is switched from the inside antenna to the outside antenna of the car. The dimensions of a usual switch-equipped coaxial connector are 3 mm in diameter and 6 mm in height.

A conventional switch-equipped coaxial connector is described in Japanese patent Kokai No. 8-167454. The coaxial connector comprises an insulating housing with a small hole and a switch mechanism press-fitted in the small hole. However, it is difficult to press-fit the switching mechanism into the small hole in addition to the following problems.

There are variations in the contact pressure and accuracy after the press-fitting. The switching mechanism is press-fitted while it is elastically deformed so that not only it is difficult to assemble but also it takes lots of time and cost. Also, it is necessary to use a complex jigs. The switch mechanism can be press-fitted obliquely, resulting in the lowered product quality. In addition, the mouth for receiving a mating pin tends to gather dust and dirt, presenting a problem of poor contact.

SUMMARY OF THE INVENTION

Accordingly, it is an object of the invention to provide a method of making a switch-equipped coaxial connector which permits easier assembly with a shorter time at lower costs than before.

According to one aspect of the invention there is provided a method of making a switch-equipped coaxial connector, which comprises the steps of stamping a pair of switching members from a metal sheet; bending the stamped switching members to complete the switching members; press-fitting the switching members into separate housing sections; assembling the housing sections so as to connect the switching members; and providing an outer conductor over the housing sections.

According to another aspect of the invention there is provided a method of making a switch-equipped coaxial connector, which comprises the steps of simultaneously stamping a pair of switching members from a flat conductive sheet; bending the stamped switching members except for press-fit sections to complete the switching members; simultaneously press-fitting the switching members linked together into elongated cavity halves of respective housing sections linked together; severing the switching members from a carrier; assembling the housing sections to connect the switching members with a predetermined contact pressure; and providing an outer conductor over the housing sections.

According to one embodiment of the invention, the step of providing the outer conductor comprises covering the housing sections with the outer conductor so as to prevent separation of the housing sections.

DESCRIPTION OF THE PREFERRED EMBODIMENTS

Figure 1:
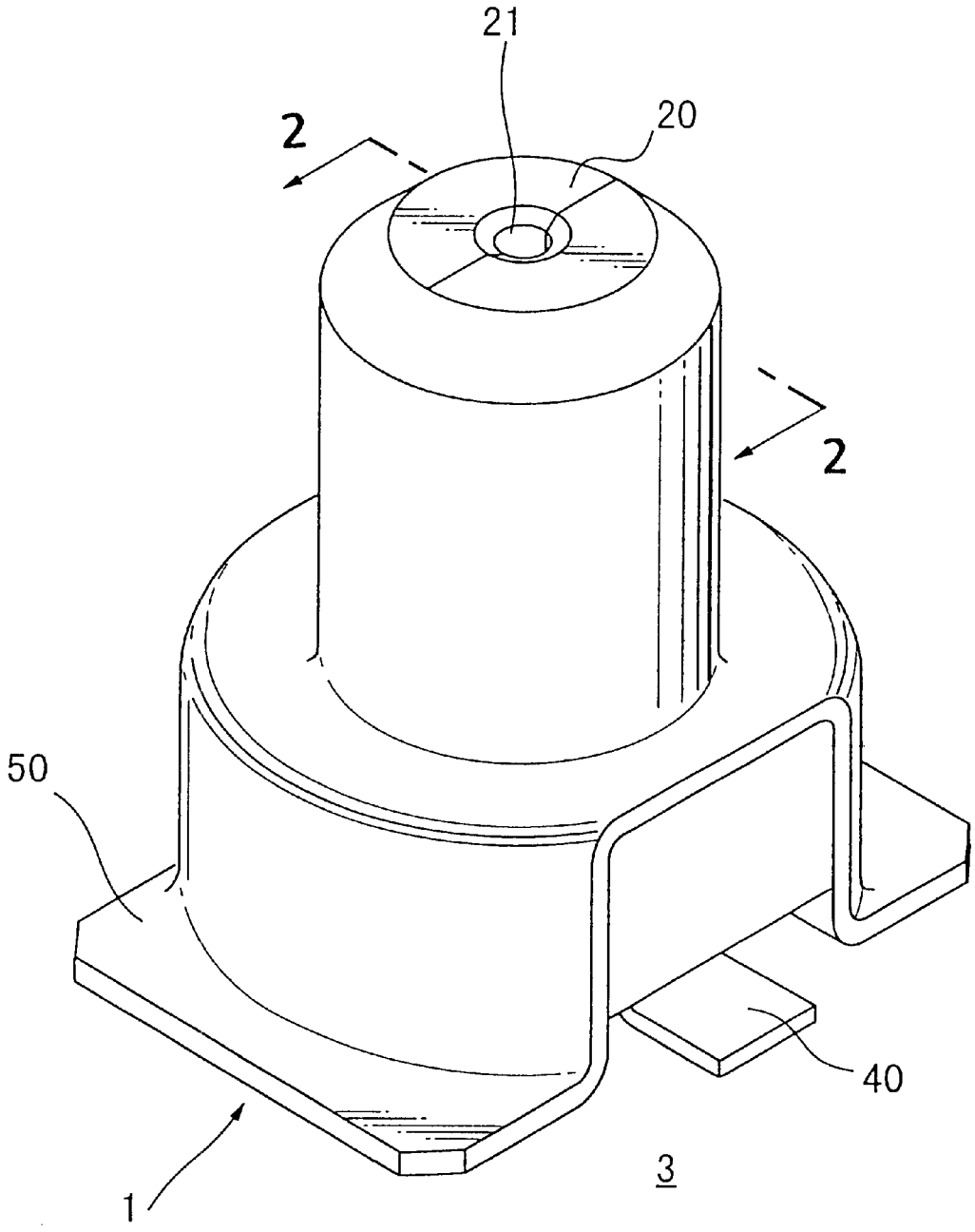
FIG. 1 is a perspective view of a switch-equipped coaxial connector according to an embodiment of the invention.
Figure 2:
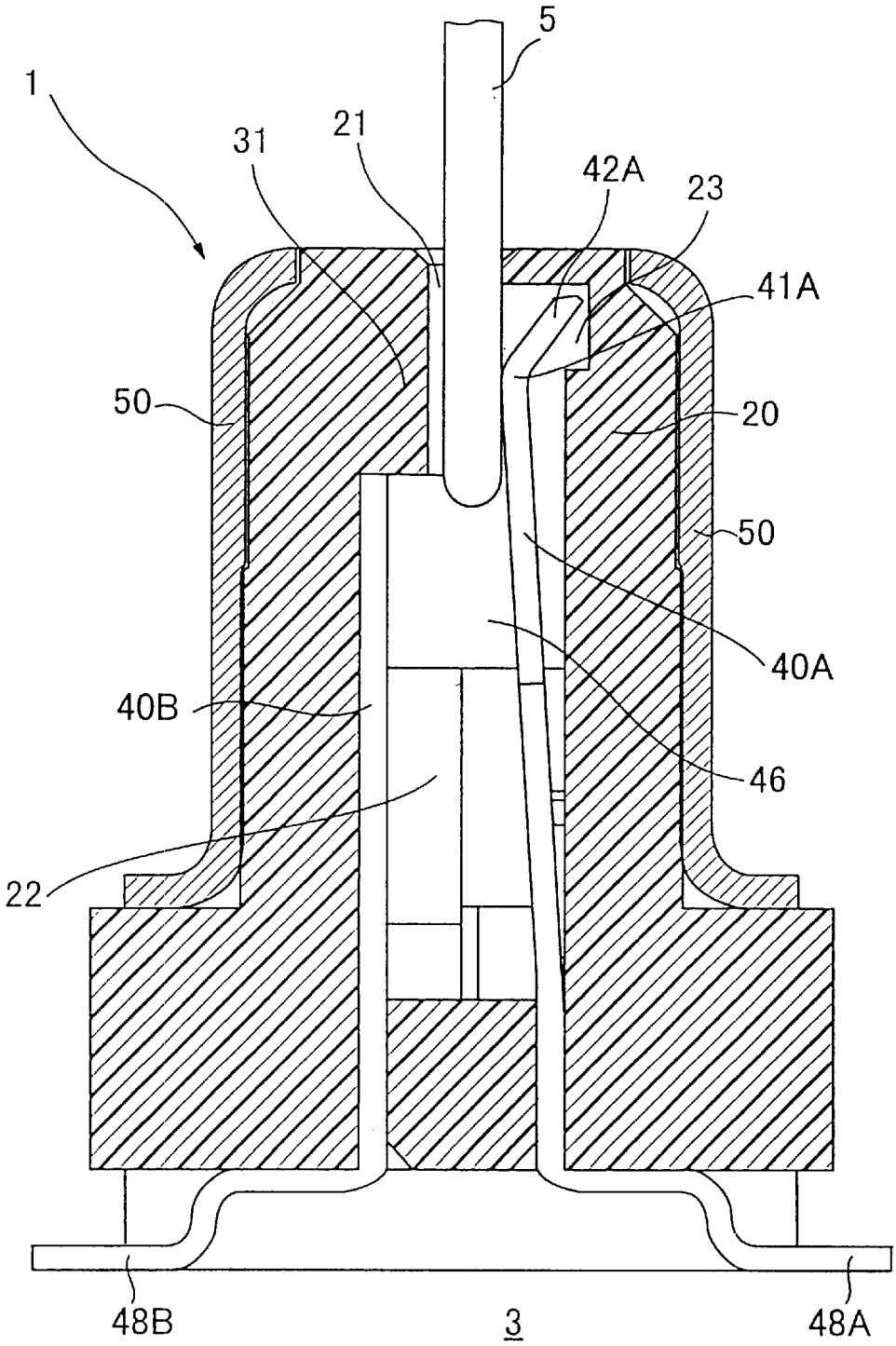
FIG. 2 is a sectional view taken along line 2—2 of FIG. 1.

FIG. 1 shows a switch-equipped coaxial connector. FIG. 2 shows in section the coaxial connector into which a mating pin is inserted. The coaxial connector 1 comprises an insulating housing 20, a switch mechanism 40, and an outer conductor 50.

The insulating housing 20 has a mouth section 21 through which a mating pin 5 is inserted and an elongated cavity section 22 for accommodating the mating pin 5. The switching mechanism 40 extends along the elongated cavity 22 and switches circuits by the action of the mating pin 5. It comprises a switching spring 40A and a connection plate 40B. The switching spring 40A and the connection plate 40B extend along the elongated cavity 22 or the insertion direction of the mating pin 5. The switching spring 40A and the connection plate 40B are soldered to a board 3 at ends 48A and 48B, respectively.

The switching spring 40A is normally displaced toward the connection plate 40B. Consequently, before the mating pin 5 is inserted, the switching spring 40A and the connection plate 40B are connected to each other. The connection plate 40B is fixed regardless of the mating pin 5 being inserted or not.

Figure 4:
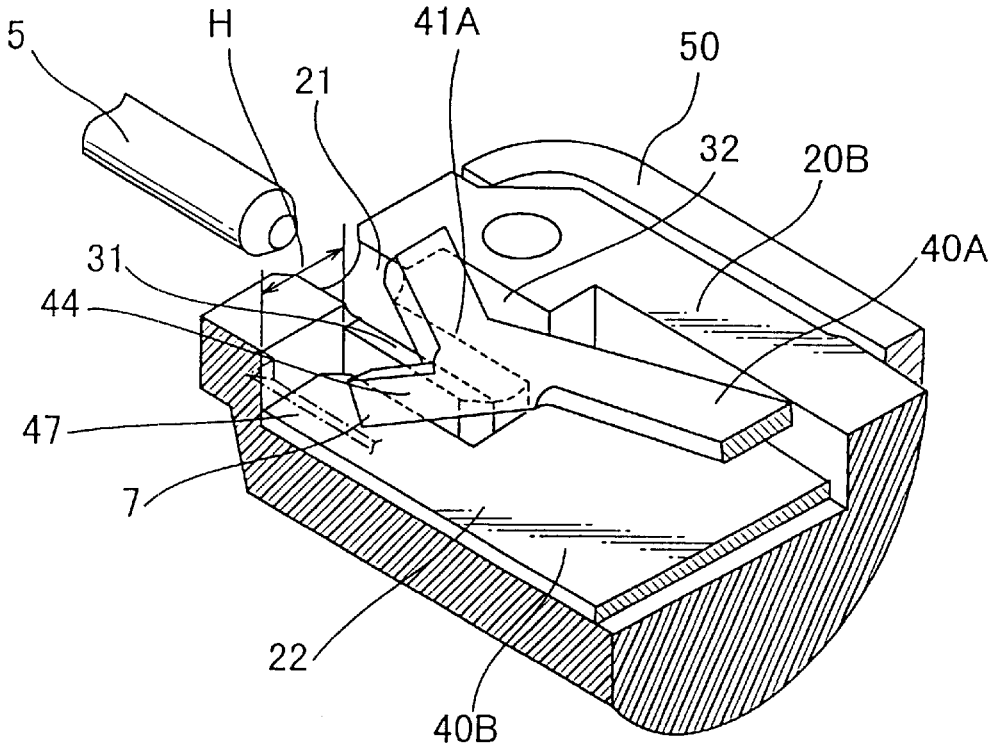
FIG. 4 is a perspective view of a front portion of the second housing section after the first and second housing sections are assembled.

When the mating pin 5 is inserted in the elongated cavity 22, the switching spring 40A is brought into mechanical and electrical contact with the mating pin 5 and displaced away from the connection plate 40B or in the direction perpendicular to the mating pin. A recess 23 is provided in the insulating housing to receive the front end 42A of the switching spring 40A. As best shown in FIG. 4, when the switching spring 40A is displaced away from the connection plate 40B, it is separated at a contact point 7 from the connection plate 40B, thereby switching circuits. In FIG. 2, the circuits have been switched. By connecting the mating pin 5 to the outside antenna of a car and the connection plate 40B to the inside antenna of a mobile phone it is possible to switch from the inside antenna to the outside antenna. When the mating pin 5 is removed from the elongated cavity 22, the switching spring 40A is displaced by its elastic force toward the connection plate 40B, thereby making a contact with the connection plate 40B.

The insulating housing 20 is covered by an outer conductor 50 which is separated electrically from the switching mechanism 40. As best shown in FIG. 1, the outer conductor 50 is soldered to the board 3 as the switching spring 40A and the connection plate 40B. The outer conductor 50 and switching spring 40A are fixed to the board 3 at right angles with each other, assuring stable attachment of the coaxial connector to the board. When plugged, the outer conductor 50 is connected to the outer terminal of a mating connector. Consequently, the coaxial connector and the mating connector are connected at two points between the outer conductor 50 and the outer conductor of the mating connector and between the switching spring 40A and the mating pin 5.

Figure 3:
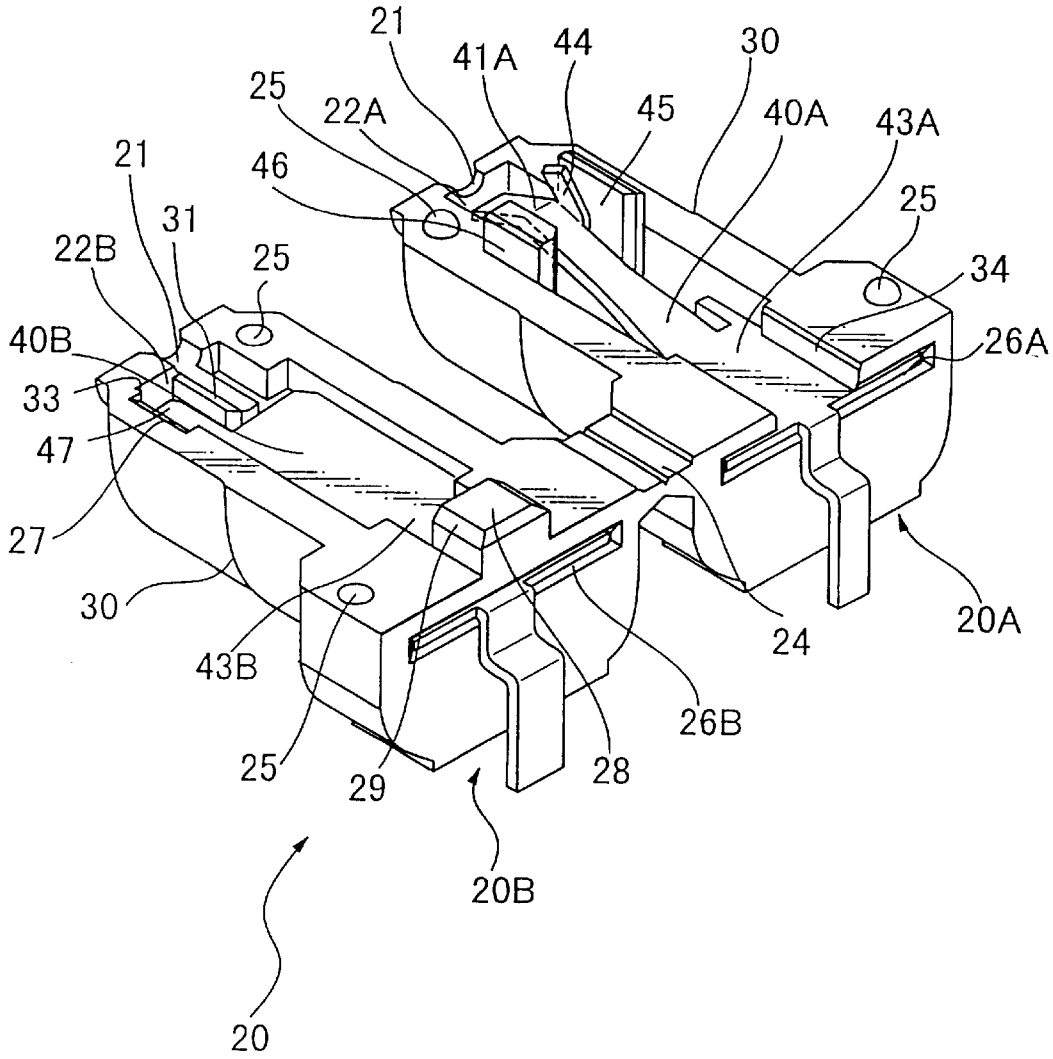
FIG. 3 is an exploded perspective view of the insulating housing and switching members fixed to the insulting housing.

The structures of the housing and the switching mechanism will be described in more detail with reference to FIG. 3, wherein the switching mechanism is fixed in the insulating housing before assembling.

The insulating housing 20 is divided into two housing sections 20A and 20B. The insulating housing 20 may be divided into more sections. One of the advantages of division of the housing is an increase in design freedom. For example, it is impossible to provide the recess 23 (FIG. 2) unless the housing is divided. In this way, it is possible to mold the complicated inside structure of the insulating housing in a metal mold. Other advantages will be apparent from the following description.

The first and second housing sections 20A and 20B receive the switching spring 40A and the connection plate 40B, respectively. These housing sections are linked to each other by a linkage section 24 so that they are joined together accurately by turning one of them toward the other. The linkage section 24, however, is not essential. A plurality of projections and indentations 25 are provided in the housing sections 20A and 20B to facilitate accurate assembling of the housing sections 20A and 20B into one body.

The switching spring 40A is press-fitted into the first housing section 20A before assembling by press-fitting the enlarged flat press-fit section 43A into the press-fit slit 26A of the first housing section 20A so that the front portion of the switching spring 40A is placed at a predetermined position in the elongated cavity 22. The front portion of the switching spring 40A is provided with a bend 41A for contact with the mating pin 5. The central portion 34 of the press-fit slit 26A is removed so that the bend 41A can pass through the slit 26A without receiving a pressure. A contact section 44 extends upwardly from one of the edges of the bend 26A. As best shown in FIG. 4, when the first and second housing sections 20A and 20B are assembled, the contact section 44 of the switching spring 40A makes a contact with the connection plate 40B at a point 7.

The connection plate 40B is press-fitted to the second housing section 20B prior to assembling by press-fitting an enlarged flat press-fit section 43B into a press-fit slit 26B of the second housing section 20B so that the front portion of the connection plate 40B is placed at a predetermined position in the elongated cavity 22 of the second housing section 20B.

As described above, the switching spring 40A and the connection plate 40B are press-fitted in the respective housing sections 20A and 20B prior to assembling. Consequently, it is not necessary to elastically deform the switching spring 40A and the connection plate 40B for fixing in the housing sections, making the complicated jigs unnecessary, the assembling easy, and the assembling time and cost reduced. In addition, there is no danger that the switching mechanism is press-fitted obliquely, keeping constant the contact pressure and accuracy between the switching spring 40A and the connection plate 40B, thus eliminating a cause of poor product quality.

A pair of flat members 45 and 46 extend upwardly from opposite sides of the elongated cavity 22 in the first housing section 20A. When the first and second housing sections 20A and 20B are assembled, the flat members 45 and 46 are fitted into the corresponding areas in the elongated cavity 22 of the second housing section 20B to secure the assembly of the first and second housing sections 20A and 20B. The larger flat member 45 also works as a pressure plate for holding down a front portion 47 of the connection plate 40B.

A oblique surface 27 is provided in the second housing section 20B to accommodate the contact section 44 of the switching spring 40A when the first and second housing sections 20A and 20B are assembled. A cover projection 28 is provided on the second housing section 20B to plug the central channel 34 of the first housing section 20A to close the insulating housing 20 except for the mouth 21. The airtight insulating housing 20 prevents a gas from entering the coaxial connector during soldering by reflow. Also, it permits transportation by vacuum suction of the insulating housing 20 in assembling. The edges of the cover projection 28 are tapered at 29 to facilitate smooth assembling of the housing sections 20A and 20B. Protruded portions may be provided on the side walls of the central channel 34 to improve the airtight quality of the insulating housing 20.

The outer conductor 50 covers the housing sections 20A and 20B to prevent the separation thereof. A shoulder portion 30 is provided at a middle of the insulating housing 20 to temporarily hold the outer conductor 50. Then, the outer conductor 50 is further pushed down to completely attach it to the insulating housing 20.

Other examples of preventing separation of the insulating housing sections 20A and 20B include a lock device comprising a lock arm provided on one of the housing sections and a groove provided in the other housing section, the cover projection 28 press-fitted into the central channel 34 of the first housing section 20A, and projections/indentations 25 press-fitted to each other.

FIG. 4 shows the front portion of the second housing section after assembling but before the mating pin is inserted.

A partition wall 31 extends from the mouth 21 into the elongated cavity 22 between the mouth 21 and the contact point 7 between the switching spring 40A and the connection plate 40B to prevent dust and dirt which have entered the elongated cavity through the mouth 21 from causing poor contact. No wall is provided an escape area 32 opposite to the partition wall 31 to permit escape of the dust and dirt which has entered the contact area between the switching spring 40A and the connection plate 40B.

The partition wall 31 also prevents the mating pin 5 from making contact with the connection plate 40B. Also, it guides the front portion 47 of the connection plate 40B when the connection plate 40B is press-fitted into the second housing section 20B. It is critical to accurately position the front portion 47 of the connection plate 40B because it makes contact with the contact section 44 of the switching spring 40A at the contact point 7. Grooves may be provided in the partition wall 31 or the inside wall of the housing section 20B to guide the front portion 47 to a predetermined position within the elongated cavity 22. The partition wall 31 guides the contact section 44 of the switching spring 40A to the connection plate 40B to assure making the contact point 7 between the switching spring 40A and the connection plate 40B. Even if the switching spring 40A is slightly deformed for some reason, the contact section 44 moves along the partition wall 31 to tolerate the deformation. The distance H between the partition wall 31 and the opposed wall 33 of the elongated cavity 22 is so large that if the switching spring 40A is slightly displaced, there is provided a contact point between the switching spring 40A and the connection plate 40B.

Figure 5B:
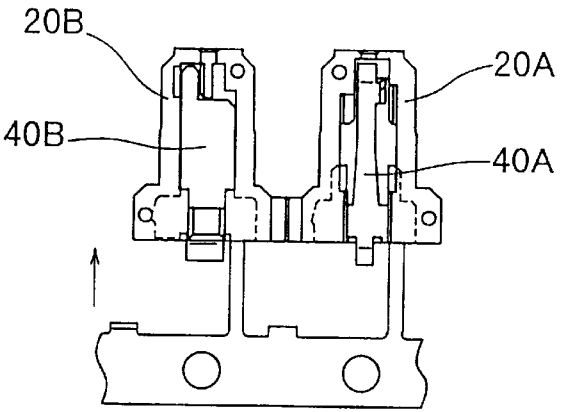
FIGS. 5(*a*)–(*c*) are schematic diagrams showing how to make the switch-equipped coaxial connector.
Figure 5C:
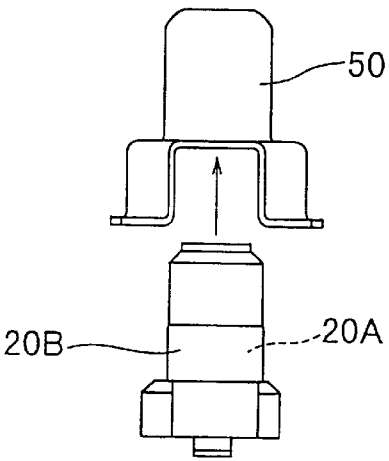
Figure 5A:
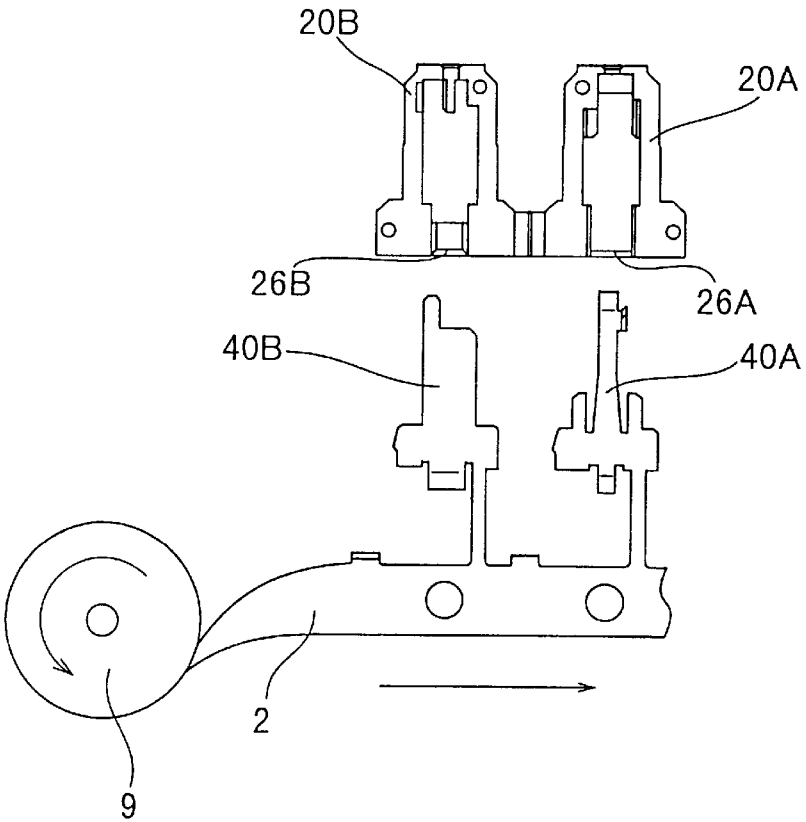

How to make the switch-equipped coaxial connector will be described with reference to FIGS. 5(*a*)–(*c*). As shown in FIG. 5(*a*), a flat metal sheet 2 from a reel 9 is stamped to provide bodies of switching spring 40A and the connection plate 40B linked to a carrier. Then, the stamped bodies are bent to predetermined shapes to provide the switching spring 40A and the connection plate 40B. As shown in FIG. 5(*b*), the switching members 40A and 40B are press-fitted into the elongated cavity halves 22A and 22B (FIG. 3) of the housing sections 20A and 20B through the slits 26A and 26B (FIG. 3). When the first and second housing sections are linked, the switching members 40A and 40B can be press-fitted in the housing at once. The connection plate 40B is press-fitted in the press-fit slit 26B along the partition wall 31 (FIG. 4). The switching spring 40A and the connection plate 40B are severed from the carrier after they are fixed to the housing sections 20A and 20B. Then, the housing sections 20A and 20B are assembled so that the switching spring 40A is brought into contact with the connection plate 40B with a predetermined pressure. Finally, as shown in FIG. 5(*c*), the housing sections 20A and 20B are press-fitted into the outer conductor 50 to complete the switch-equipped coaxial connector.

Alternatively, the outer conductor may be replaced by a conductive plating provided on the housing. In this case, it is necessary to prevent separation of the housing sections by using the lock device or press-fit members.

Not only the switching spring 40A but also the connection plate 40B may be made movable by the insertion of the mating pin 5. In this case, it is necessary to provide an insulation material on the connection plate at a contact point with the mating pin to prevent electrical connection. When the mating pin is inserted, the connection plate is brought into contact with the mating pin at the insulation material and displaced in the direction perpendicular to the insertion direction of the mating pin.

According to the invention, assembling of the switch-equipped coaxial connector is made easy, the manufacturing time and cost are reduced, and the precision of the switch mechanism is increased. In addition, dust and dirt hardly reach the contact point of the switching members.

What is claimed is:

1. A method of making a switch-equipped coaxial connector, comprising the steps of:

simultaneously stamping a pair of switching members from a flat conductive sheet;

bending said stamped switching members except for press-fit sections to complete said switching members;

simultaneously press-fitting said switching members linked together into elongated cavity halves of respective housing sections linked together;

severing said switching members from a carrier;

assembling said housing sections to connect said switching members with a predetermined contact pressure; and providing an outer conductor over said housing sections.

2. A method according to claim 1, wherein said step of providing said outer conductor comprises covering said housing sections with said outer conductor so as to prevent separation of said housing sections.

* * * * *